US007234260B2

(12) United States Patent
Acarreta

(10) Patent No.: US 7,234,260 B2
(45) Date of Patent: Jun. 26, 2007

(54) COUNTING DEVICE

(76) Inventor: Raul Delgado Acarreta, Anon Beigorri, 14-Izda., 31500 Tudela Navarra (ES)

( * ) Notice: Subject to any disclaimer, the term of this patent is extended or adjusted under 35 U.S.C. 154(b) by 34 days.

(21) Appl. No.: 10/522,763

(22) PCT Filed: Dec. 5, 2002

(86) PCT No.: PCT/ES02/00580

§ 371 (c)(1),
(2), (4) Date: Aug. 25, 2005

(87) PCT Pub. No.: WO2004/051176

PCT Pub. Date: Jun. 17, 2004

(65) Prior Publication Data

US 2006/0096144 A1 May 11, 2006

(51) Int. Cl.
*F41A 9/62* (2006.01)

(52) U.S. Cl. ..... 42/1.02; 42/1.01

(58) Field of Classification Search ..... 42/1.01–1.03, 42/1.05

See application file for complete search history.

(56) References Cited

U.S. PATENT DOCUMENTS 2,303,479 A * 12/1942 Lesnick ..... 89/33.16
2,364,509 A * 12/1944 Bertran et al. ..... 89/37.19
2,381,332 A * 8/1945 Boldt ..... 89/1.51
3,024,453 A * 3/1962 Ransom ..... 89/14.05
4,253,192 A * 2/1981 Donnally et al. ..... 455/98
5,142,805 A * 9/1992 Horne et al. ..... 42/1.02
5,303,495 A * 4/1994 Harthcock ..... 42/84
5,519,953 A * 5/1996 Villani ..... 42/1.02
5,799,433 A * 9/1998 Danner et al. ..... 42/1.05
5,983,774 A * 11/1999 Mihaita ..... 89/187.02
7,089,844 B2 * 8/2006 Becker ..... 89/9

* cited by examiner

*Primary Examiner*—Michelle Clement
*Assistant Examiner*—Bret Hayes
(74) *Attorney, Agent, or Firm*—Browdy and Neimark, PLLC

(57) ABSTRACT

Device (12) for counting shots fired by an automatic firearm (11), having a cartridge chamber containing a cartridge that can be expelled through an expulsion window and a first emission means that emits a continuous electromagnetic signal in such a manner that it is interrupted by a casing expelled from the cartridge chamber which corresponds to the used cartridge. The shot-counting device (12) of the invention is capable of monitoring the number of casings expelled from a cartridge chamber of the firearm (11) via an expulsion window and showing, on a display screen, the corresponding number of shots left available in a magazine (13) fitted to the firearm (11).

15 Claims, 2 Drawing Sheets

COUNTING DEVICE

SUBJECT OF THE INVENTION

In general terms, the present invention relates to a device for counting shots fired by a firearm. More specifically, the present invention relates to a shot counter that counts the shots fired by an automatic and/or semi-automatic firearm.

PRIOR ART

The development of firearms, such as small arms or pistols, has to date led to a pistol magazine having the capacity to be able to house more than one dozen cartridges, for example 18. Specifically, a cartridge comprises a casing, projectile or bullet.

However, in a firearm of the revolver type, i.e. a firearm having a cylinder normally capable of housing 6 cartridges, it is relatively easy mentally to monitor the number of cartridges fired or used. In the case of a pistol fitted with a magazine capable of storing 18 cartridges, plus one in the pistol's cartridge chamber, it can become arduous and complicated mentally to monitor the shots fired and the number of cartridges available in the firearm's magazine, with the result that the pistol user may be surprised by the last shot without prior warning, the pistol's slide being locked.

Therefore, it is necessary to develop a device capable of counting the number of shots fired and thus the number of unused cartridges remaining in the magazine that, at a given moment, is fitted to a small arm such as a pistol. The shot-counting device is also capable of showing the number of cartridges available in the magazine.

CHARACTERIZATION OF THE INVENTION

Device for counting shots fired by a firearm, comprising a cartridge chamber containing a cartridge that can be expelled through an expulsion window, comprising a first emission means that emits a continuous electromagnetic signal in such a manner that it is interrupted by a casing expelled from the cartridge chamber and corresponding to the used cartridge.

The shot-counting device of the invention is capable of monitoring the number of casings expelled from a cartridge chamber of the firearm via an expulsion window and showing, on a display screen, the corresponding number of shots left available in a magazine fitted to the firearm.

The counter also keeps an accumulative score of the total number of casings expelled from the cartridge chamber and is thus capable of showing the total number of shots fired with the firearm so that it is possible to determine the service life of the firearm or of one or more parts of it.

A further object of the invention is to guarantee that the information data shown on a screen viewed by a user of the firearm using same can be seen.

A further object of the counter of the invention is to keep a partial score of the shots fired with a specific magazine. The partial magazine counter can therefore be set to zero by actuating a data input means.

A further object of the invention is to produce a lightweight counter of small size and low cost.

BRIEF DESCRIPTION OF THE FIGURES

A more detailed explanation of the invention is given in the following description based on the attached figures, in which.

DESCRIPTION OF THE INVENTION

Figure 1:
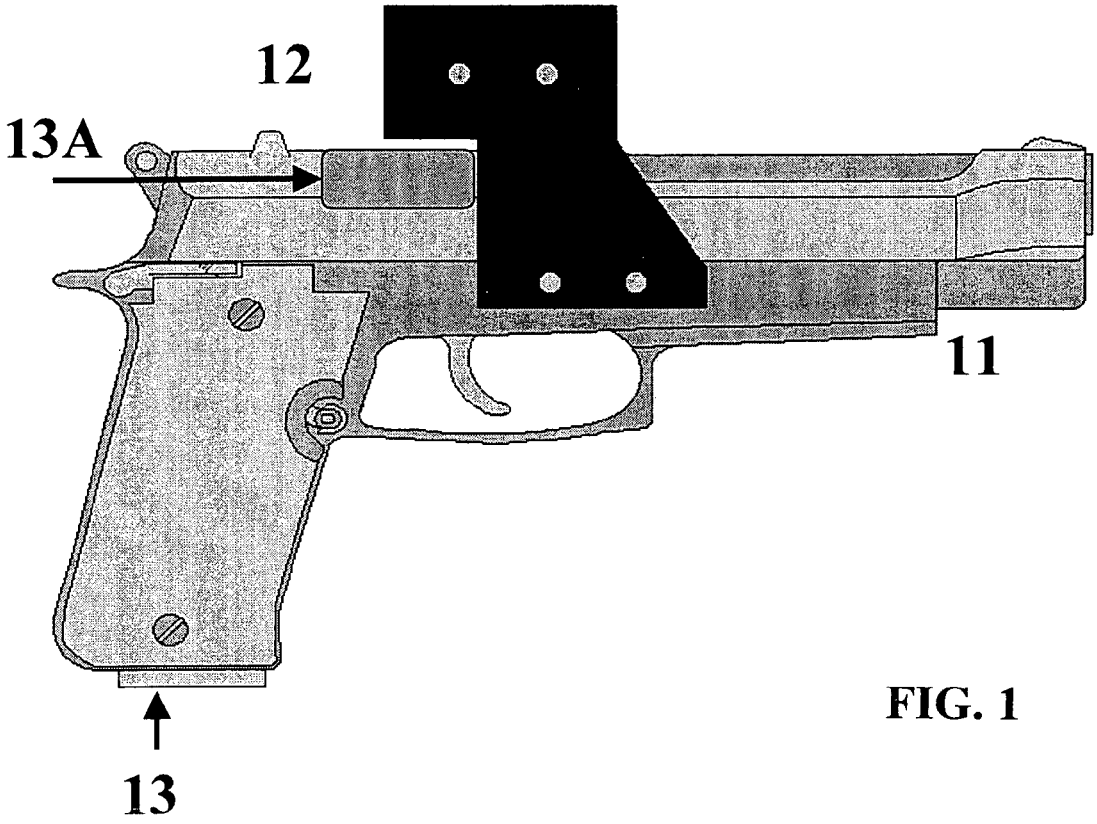
FIG. 1 shows a view in elevation of a counting device according to the invention.

The device 12 for counting shots fired by an automatic and/or semi-automatic firearm is shown in FIG. 1. In describing the invention, the automatic and/or semi-automatic firearm example taken will be a pistol. Thus, this type of firearm 11 has a cartridge chamber located at the opposite end from the muzzle of the bore of the barrel, in which the cartridge is placed or housed.

On one side of the cartridge chamber there is an expulsion window 13A from which the casing corresponding to the cartridge struck by the firing pin of the pistol 11 is expelled. That is to say, when a shot is fired with the firearm 11, the cartridge casing is expelled, at a certain speed, from the cartridge chamber via the expulsion window. Likewise, a cartridge that is in the cartridge chamber and that has not been struck may be removed from the cartridge chamber via the expulsion window 13A.

Figure 3:
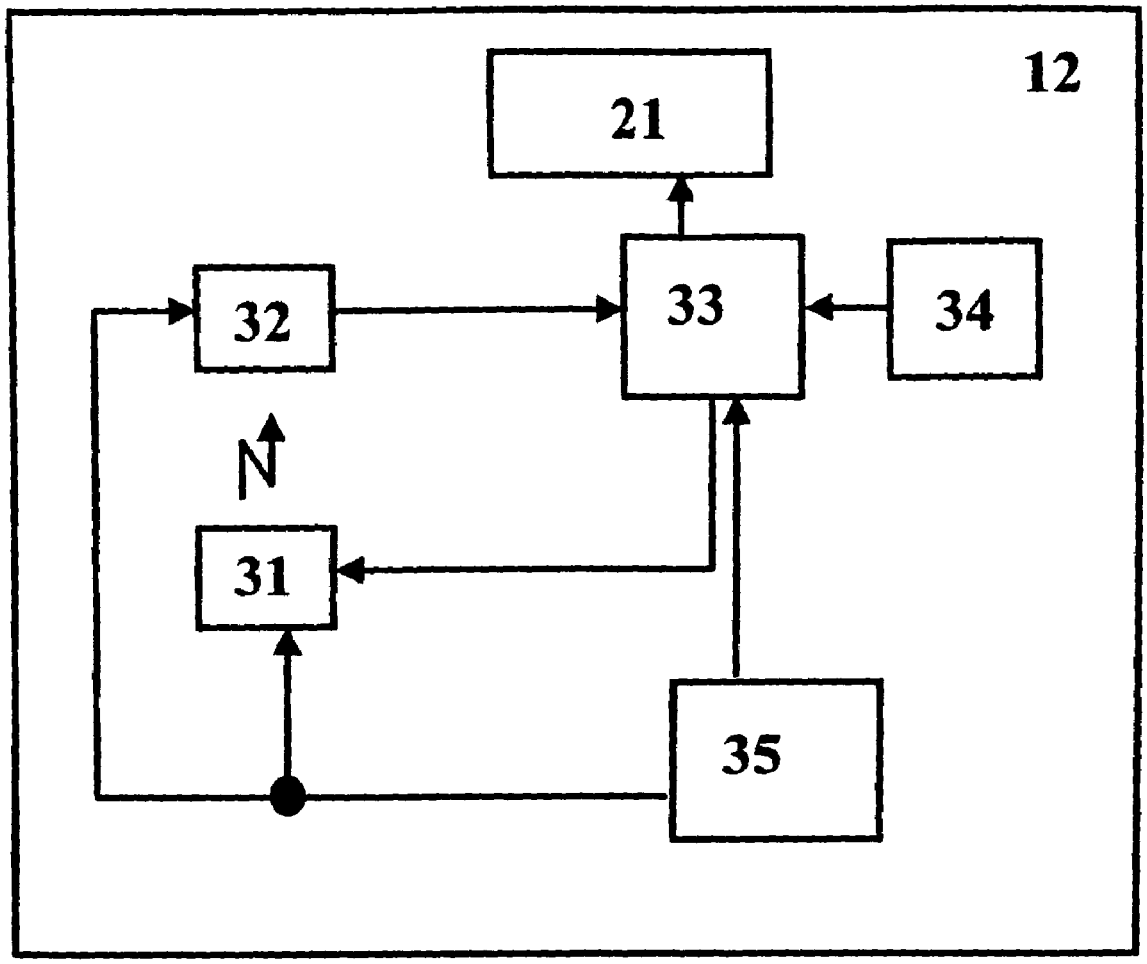
FIG. 3 shows a block diagram of the counting device according to the invention.

FIG. 3 shows a block diagram of the counting device 12 comprising a first means 31 for emitting electromagnetic signals such as infrared rays, which are received in a first receiving means 32 designed to detect possible variations or interruptions in the infrared signal received. The first receiver 32 is connected to a programmable logic control means 33 that in turn is connected to a display screen 21 designed visually to show information data associated with the number of shots fired by the firearm 11.

In a similar way, the programmable logic control means 33 based on a programming means such as a microprocessor is connected to a data input means 34 comprising an alphanumeric and function keyboard as vertical upward and downward movement, whereby data may be input. Furthermore, a number of keys may be associated with various characters and/or functions.

The keyboard 34 makes it possible, manually, to change information displayed on the screen 21 to other information in an easy and rapid manner, i.e. if the initial selection was to display the number of shots corresponding to the magazine 13 fitted to the firearm 11, by actuating the corresponding key 34 the total number of shots fired by the firearm 11 may be displayed.

When a shot is fired, the corresponding casing is expelled via the expulsion window 13A such that the casing interrupts the continuous infrared signal emitted from the first emitter 31. Once the first receiver 32 detects the momentary absence of infrared signal, it generates an electrical control signal corresponding to the interruption of the infrared signal received, and this is supplied to the microprocessor 33 that increments, by one unit, not only the score of the number of shots fired by the firearm 11 but also the score of the number of shots fired using the magazine 13 fitted to said weapon.

Consequently, the screen 21 of the counter may show, visually, information selected by the user of the firearm 11 from the various information items that the screen 21 of the counter is able to show, such as total number of shots fired, number of shots remaining in the current magazine 13, number of shots fired using the current magazine 13, and the like. To this end, the user of the weapon merely has to select, by means of the keyboard 34, the type of information he wishes to see on the screen 21.

Figure 2:
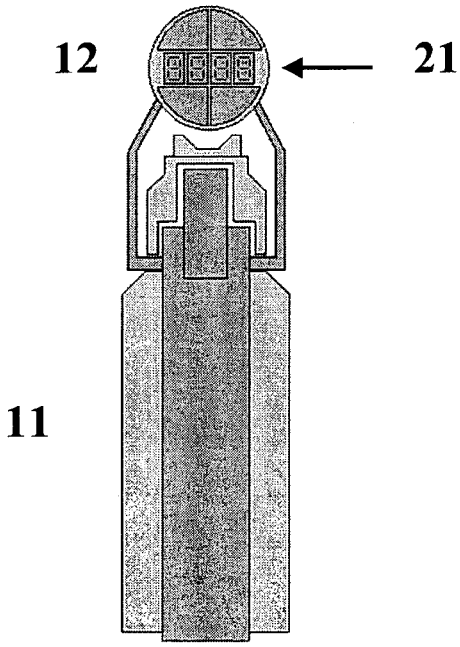
FIG. 2 shows a profile view of the counting device according to the invention.

The counter 12 is located on the upper part of the barrel of the firearm 11, over the expulsion window and such that the display screen 21 can be seen by the user of the firearm 11 when he is about to fire a shot, i.e. the screen 21 faces the user (cf. FIG. 2). Also, the first emitter 31 and the first receiver 32 have to be located such that it is guaranteed that the casing, when expelled from the cartridge chamber, will interrupt the infrared signal.

In addition, the screen 21 may be offset from the axis of the bore of the barrel of the firearm 11, i.e. it is not on the vertical of the barrel, such that in this position the firearm 11 can be fitted with a telescopic sight, for example. Similarly, the counter 12 has to be removed from the barrel so that the user of the firearm 11 can use the sight point of the weapon 11 when firing a shot.

The counter 12 comprises a battery 35 that supplies electrical energy to all the circuits of the counter 12. The battery 35 is small in size and is a long-life type, such as a lithium battery that provides a stand-alone capacity of over 10,000 operating hours.

To extend the life of the battery 35 as far as possible, the counter 12 has a switching means (not shown), which switches the counter 12 on and off such that when the firearm 11 is to be used the switch is set to the on position and when use of the weapon 11 has finished the switch is set to the off position. In this condition, the microprocessor 33 continues to receive an electrical energy supply with the end of keeping certain information stored, such as the total number of shots fired with the firearm 11. The counter 12 therefore includes circuitry associated with the microprocessor 33 and the battery 35, which fulfils the task of maintaining the electrical energy supply to the microprocessor 33 during the time for which the counter 12 is in the off state.

The display screen 21 may be of the liquid crystal LCD, electroluminescent, plasma or similar type, as such technologies involve a lower electrical energy consumption. Also, the screen 21 may be a touch-sensitive screen, and in such a case certain functions of the data input means 34 can be implemented from said screen 12.

Furthermore, the counter 12 may allow remote control of the consumption of ammunition by the firearm 11, as the counter may be divided into two parts such that one of them is located on the weapon 11 and the other may be separate from the firearm 11.

The counter 12 may also include a laser aiming device for aiming the firearm 11 at an objective such that the laser aiming device is located behind the display screen 21.

The part of the counter 12 located on the weapon 11 includes a second means for emitting electromagnetic signals, such as radio signals. The second emitter is connected to the first receiver 32 such that the interruption of the infrared signal is converted into a radio signal transmitted to the separate part of the counter 12, which includes a second reception means that receives the signal transmitted via radio and converts it into an electrical signal that is supplied to the microcomputer 33.

Obviously, other components may be separate from the counter 12, for example the screen 21 is separate from the counter 12. In such a case, the second emitter receives an electrical signal from the microcomputer 33 and this is converted into a radio signal that is emitted to the second receiver that transforms it into a signal supplied to the screen so that the desired information may be viewed.

As a result, on the basis of the separation type achieved for the counter 12, a predetermined number of components of the counter 11 will be fitted to the firearm 11. Obviously, each part of the counter 12 includes a battery that supplies the electrical energy to enable the two parts of the counter 12 to operate.

The invention claimed is:

1. A device for counting shots fired by a firearm (11), comprising a cartridge chamber containing a cartridge that can be expelled through an expulsion window (13A), characterized in that the counting device (12) comprises a first emission means (31) designed to emit a continuous electromagnetic signal in such a manner that said continuous electromagenetic signal is interrupted by a casing expelled from the cartridge chamber and corresponding to the fired cartridge.

2. The counting device as claimed in claim 1, in which said continuous electromagnetic signal emitted is received in a first receiving means (32) connected to a programmable logic control means (33) that in turn is connected to a display screen (21).

3. The counting device as claimed in claim 2; when said continous electromagnetic signal emitted is interrupted by an expelled casing, the programmable logic means (33) increments and/or decrements, by at least one unit, a score value stored in the programmable logic means (33) such that the new score value can be shown on the display screen (21).

4. The counting device as claimed in claim 3; a stored score corresponds to the total number of shots fired by a firearm (11).

5. The counting device as claimed in claim 3; the score stored corresponds to a partial number of a total of shots fired and/or available in a magazine (13) fitted to the firearm (11).

6. The counting device as claimed in claim 2; which includes a data input means (34) designed to select at least one information item stored in the programmable logic means (33) such that a type of information selected is shown visually on the display screen (21).

7. The counting device as claimed in claim 6; the data input means (34) includes a set of alphanumeric keys.

8. The counting device as claimed in claim 7; the data input means (34) also includes a set of function and/or information selection keys.

9. The counting device as claimed in claim 1; said continuous electromagnetic signal is an infrared-ray signal.

10. The counting device as claimed in claim 2; the display screen (21) is either a liquid-crystal, LSD screen, electroluminescent screen, or a plasma screen.

11. The counting device as claimed in claim 1; wherein the counting device (12) is located on a barrel of the firearm (11) such that the display screen (21) is facing the user using the firearm (11).

12. The counting device as claimed in claim 11; the counting device (12) includes a laser aiming device for aiming that is located behind the display screen (21).

13. The counting device as claimed in claim 11; there is a predetermined space between the barrel and the counting device (12) such that sight point located on the muzzle of the barrel is visible therebetween.

14. The counting device as claimed in claim 1, in which the counting device (12) is divided into at least two parts connected via electromagnetic signals such that remote control of a consumption of ammunition by the firearm (11) is possible.

15. The counting device as claimed in claim 14; the electromagnetic signal is a radio signal.

* * * * *